United States Patent [19]

Howard et al.

[11] Patent Number: 4,831,407

[45] Date of Patent: May 16, 1989

[54] PROCESS UNIT FOR AN IMAGING APPARATUS

[75] Inventors: Alan C. R. Howard, Westoning; David M. Newbury; Geoffrey Watts, both of Welwyn Garden City, all of England

[73] Assignee: Xerox Corporation, Stamford, Conn.

[21] Appl. No.: 131,074

[22] Filed: Dec. 10, 1987

[30] Foreign Application Priority Data

Dec. 15, 1986 [GB] United Kingdom ..... 86 29943

[51] Int. Cl.[4] ..... G03G 15/00

[52] U.S. Cl. ..... 355/3 R; 355/219

[58] Field of Search ..... 355/3 R, 3 CH, 3 TR, 355/3 DR; 250/324–326

[56] References Cited

U.S. PATENT DOCUMENTS

| | | | |
|---|---|---|---|
| 3,985,436 | 10/1976 | Tanaka et al. | 355/8 |
| 4,116,556 | 9/1978 | Tanaka et al. | 355/3 TR Y |
| 4,462,677 | 7/1984 | Oneda | 355/3 R |
| 4,470,689 | 9/1984 | Nomura et al. | 355/3 R |
| 4,575,221 | 3/1986 | Onoda et al. | 355/3 R |
| 4,609,276 | 9/1986 | Mitzutani | 355/3 R |

FOREIGN PATENT DOCUMENTS

| | | | |
|---|---|---|---|
| 0109371 | 8/1981 | Japan . | |
| 60-73554 | 4/1985 | Japan | 355/3 CH |
| 61-97663 | 5/1986 | Japan | 355/3 R |

*Primary Examiner*—Arthur T. Grimley
*Assistant Examiner*—J. Pendegrass

[57] ABSTRACT

A process unit which can be removably mounted in a main assesmbly of a reproducing machine such as a xerographic copier. The unit comprises a housing enclosing an imaging member and, optionally, other processing means such as a development device, a cleaner, and a charge corotron. The unit also comprises an integral transfer corotron which has one end hingedly mounted on the housing enabling the corotron to be pivoted open for jam clearance. Preferably, the end of the corotron remote from the pivoted end is retained in the unit by a latch which is opened automatically to release the corotron when the unit is inserted into the main assembly. A flexure within the main assembly normally urges the corotron to its operative position when the unit is inserted in the main assembly, but the flexure may be withdrawn so that the corotron pivots open about its hinged end to permit jam clearance. When the unit is withdrawn from the main assembly the corotron is automatically latched back into the unit housing.

13 Claims, 8 Drawing Sheets

PROCESS UNIT FOR AN IMAGING APPARATUS

CROSS REFERENCE TO RELATED APPLICATIONS

Reference is made to the following copending applications filed concurrently herewith: Application Ser. No. 131,163 entitled "Process Unit incorporating A Charging Device" in the name of Alan C. R. Howard et al. Application Ser. No. 131,162 entitled "Process Unit For An Imaging Apparatus" in the name of Robert A. Carter Application Ser. No. 131,075 entitled "Process Unit For An Imaging Apparatus" in the name of Alan C. R. Howard et al.; Application Ser. No. 130,920 entitled "Electrostatographic Reproducing Machine and Process Unit Therefore" in the name of David M. Newbury; Application Ser. No. 131,073 entitled "Fiber Traps In Copiers" in the name of Philip R. Thompson Reference is also made to copending Application Ser. No. 038,093 entitled "Process Unit For An Imaging Apparatus" filed April 4, 1987 in the name of Robert A. Carter.

BACKGROUND OF THE INVENTION

This invention relates to a process unit adapted to be removably mounted in a main assembly of a reproducing machine, the process unit comprising at least an imaging member, and a charging device. The invention also relates to a reproducing machine, particularly a xerographic copying machine, including such a process unit.

In the art of electrostatographic copying there is a trend to incorporate the imaging member, i.e. the photoreceptor, together with other process means such as a charge corotron, a development device, and a cleaning device in a removable process unit or so-called cassette as disclosed for example in U.S. Pat. No. 3,985,436 to Tanaka et al. The use of such a cassette enables the easy replacement of those parts of the copying machine which are most likely to deteriorate with use, especially the photoreceptor, but also the development and cleaning systems as well as the charge corotron wire. A further advantage of containing the major process elements within a cassette is that interchangeable cassettes may be used in a given copying machine to provide different development characteristics or different colored development. A problem with the cassette disclosed in U.S. Pat. No. 3,985,436 is that when it is removed from the main assembly of the copying machine the part of the imaging member where image transfer occurs in the copying machine is unprotected and is therefore susceptible to damage or contamination, and also to light exposure which can result in premature deterioration of the photosensitive material on the imaging member. Needless to say, these adverse effects are likely to impair the quality of image formation.

PRIOR ART

With a view to overcoming this problem it has been proposed to provide a cassette with a retractable cover for shielding and protecting the imaging member. For example U.S. Pat. No. 4,470,689 to Nomura et al discloses a cassette with a movable cover mounted below the cassette housing, but integral therewith. An actuating device is included whereby the cover is automatically rotated to a closed position to shield the imaging member when the cassette is removed from the main assembly of the copying machine, and when the cassette is inserted into the main assembly the cover is automatically rotated to an open position to expose the imaging member at the area where image transfer occurs. The arrangement is such that the cover remains open during normal operation of the machine.

A similar protection cover for a process unit is described in U.S. Pat. No. 4,462,677 to Onoda wherein the cover is moved from a protective position to an open position in response to another operation of the main apparatus such as for example opening the machine to remove a paper jam. These arrangements suffer the drawback that they employ relatively elaborate mounting and actuating mechanisms for the covers which are likely to result in increased cost and diminished reliability.

U.S. Pat. No. 4,609,276 to Mitzutani illustrates similar process units for use in image formation apparatus. FIGS. 10A through 10G illustrate several alternative arrangements for a process unit to contain various process means. FIG. 10G illustrates such a unit which in addition to including an imaging drum, charging device and developer also includes a transfer discharger and a protective cover. In this regard attention is also directed to the discussion in Onoda of FIGS. 13A to 13F at column 8, lines 35 to 64 and Nomura et al of FIGS. 15A to 15F at column 8 lines 15 to 45 concerning the inclusion of a transfer discharger in the process unit. Incorporating the transfer charging device in the cassette housing has the advantage that the charging device itself shields and protects the imaging member from light exposure, damage, and contamination even when the unit is removed from the main assembly of the copying machine, thus dispensing with the need for a separate protecting cover. An additional advantage of having the transfer charging device integral with the unit housing is that it will be replaced automatically whenever the process unit is exchanged for a fresh one without having to change the transfer charging device separately.

As the transfer charging device is incorporated in the process unit, a copy sheet actually has to enter the process unit in order to have an image transferred thereto from the imaging member. With this arrangement it may be a difficult and delicate operation to clear a copy sheet if it becomes jammed in the process unit in the vicinity of the transfer charging device without damaging the photoreceptor.

SUMMARY OF THE INVENTION

According to a first aspect of the present invention, there is provided a process unit adapted to be removably mounted in a main assembly of a reproducing machine, comprising an imaging member and a hingedly mounted charging device.

The hinged mounting enables the charging device to be pivoted to an open position away from the imaging member when the process unit is in the reproducing machine to facilitate jam clearance without damaging the imaging member.

In a specific embodiment the charging device, in the form of an elongate transfer corotron, is hingedly mounted at one end, and has its second opposite end retained in the process unit by latch means. Preferably, the latch means are adapted to release the charging device automatically when the process unit is inserted into the main assembly According to a further aspect of the present invention, there is provided a reproducing machine comprising a main assembly, and a process unit in accordance with the first aspect of the invention adapted to be removably mounted in said main assembly.

The main assembly suitably comprises means for supporting the charging device in a predetermined location relative to the main assembly when the process unit is inserted therein. The support means may comprise resilient flexures. In one embodiment, where the process unit comprises an elongate charging device which has one end hingedly mounted and the second opposite end retained by a latch as mentioned above, respective support means may be provided at each of the two ends of the charging device, the support means at the latch end being withdrawable from the main assembly whereby the charging device is pivotable about the hinged end. Normally, both of the support means act to hold the charging device in an operative position when the process unit is fully inserted in the main assembly. It is only when the withdrawable support is actually withdrawn from the main assembly that the charging device can be pivoted open about its hinged end. Additionally, a member may be included included in the main assembly which provides an to limit the pivotal movement of the charging device. In a preferred form the withdrawable support means at the latch end of the charging device comprises a double sided ramp member in back-to-back configuration defining an apex therebetween, wherein the latch end of the charging device is supported by the apex when both the ramp member and the process unit are fully inserted in the main assembly.

BRIEF DESCRIPTION OF THE DRAWINGS

An embodiment of the invention will now be described, by way of example, with reference to the accompanying drawings in which:

FIG. 11 is a schematic view in cross section of a reproducing machine having a process cassette according to the present invention.

DETAILED DESCRIPTION OF THE INVENTION

Figure 1:
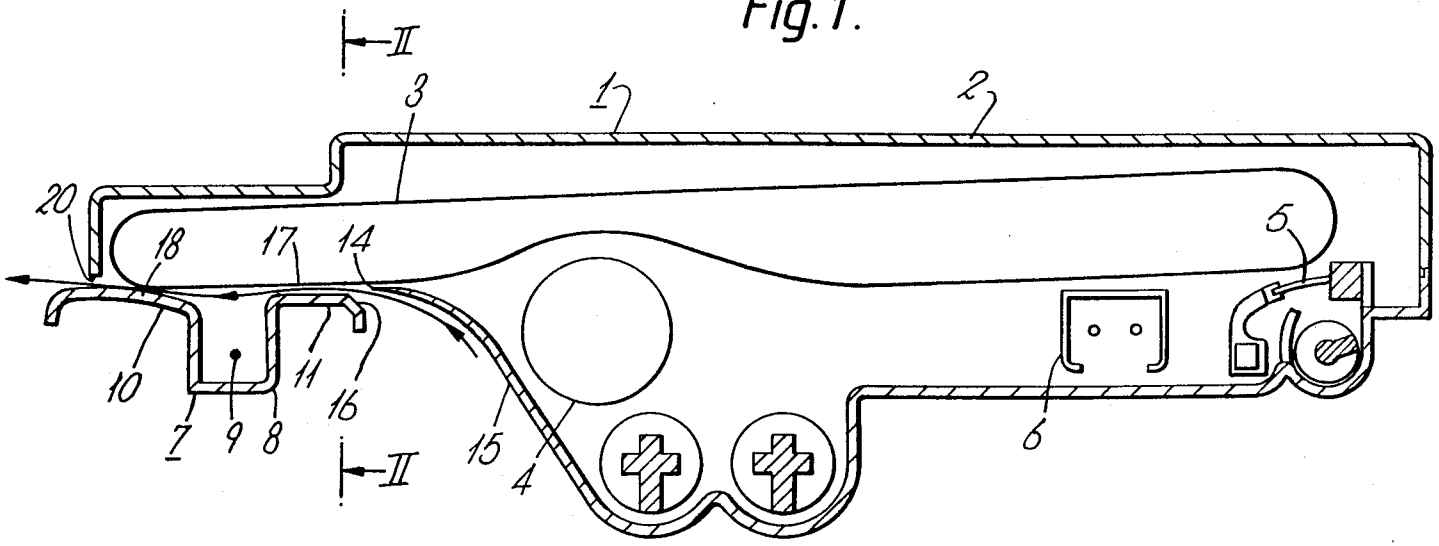
FIG. 1 is a schematic cross section of a process unit having an integral transfer corotron in accordance with the invention.

It is noted that, for the sake of clarity, the Figures are not drawn to scale. In particular in the sectional views the dimensions in the vertical direction have been exaggerated. The same features are denoted by the same reference numerals in each of the Figures.

The process unit or cassette 1 shown in FIG. 1 is designed to be removably mounted in the main assembly 100 of a xerographic copier as described, for example, in the aforementioned U.S. patents and also in our copending United States patent application Ser.No. 038,093 filed Apr. 14, 1987, entitled Process Unit For An Imaging Apparatus in the name of Robert A. Carter commonly assigned to the assignee of the present invention to which reference is invited for further details. The cassette 1 comprises a housing 2 made for example, primarily of polystyrene, which encloses an imaging member in the form of a belt photoreceptor 3 in addition to various process means, in particular a development device 4, a cleaner 5, and a charge corotron 6. The belt photoreceptor is an endless flexible belt having a photosensitive surface. In the arrangement shown, when the cassette 1 is removed from the main assembly of the copier, the belt is only loosely retained in the cassette but when the cassette is inserted into the main assembly of the copying machine, the photoreceptor belt is supported in an operative position by a member 40 forming part of the main assembly (see especially FIG. 8). A cassette having this kind of loosely retained photoreceptor arrangement forms the subject of our aforementioned copending United States patent application Ser. No. 038,093.

Returning to FIG. 1, a transfer charging device 7 is included in the cassette housing in the vicinity of the photoreceptor belt at the area where a toner image is to be transferred from the belt to a copy sheet. The technique of actually transferring a toner image is well known to those skilled in the art and no further details need be given here. The transfer charging device is in the form of a corotron having an outer shield 8 which, as is conventional, is substantially U-shaped and made, for example, of stainless steel. A corona wire 9 extends the full length of the shield 8 and is spaced apart from the walls thereof in the usual manner.

Figure 2:
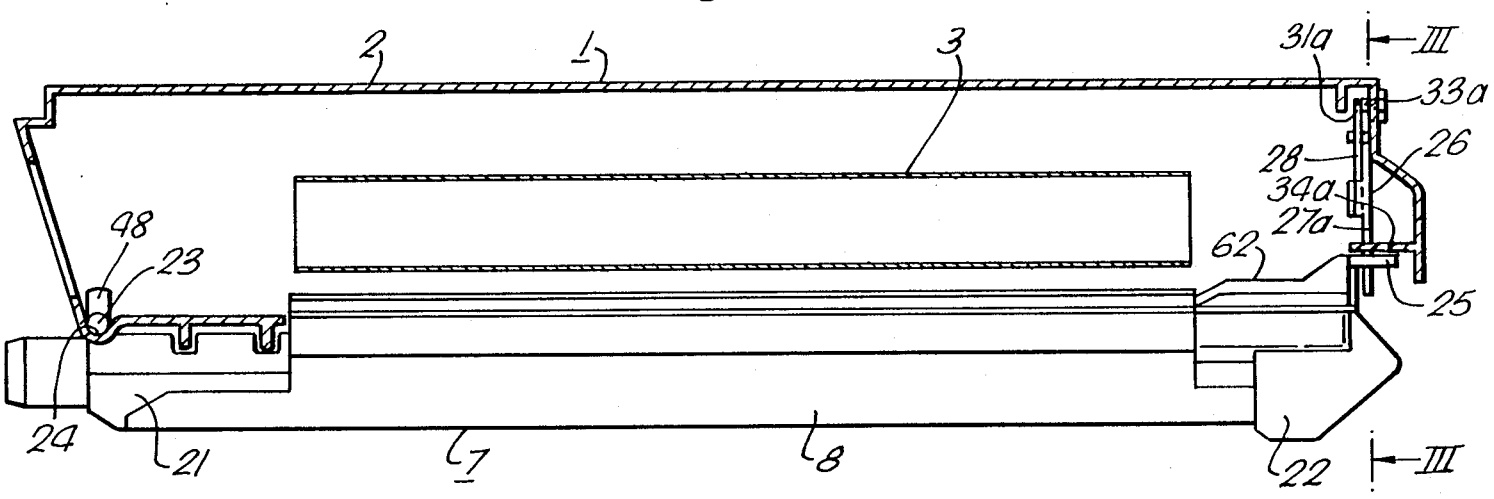
FIG. 2 is a schematic cross section of the process unit taken on the line II—II in FIG. 1.
Figure 3:
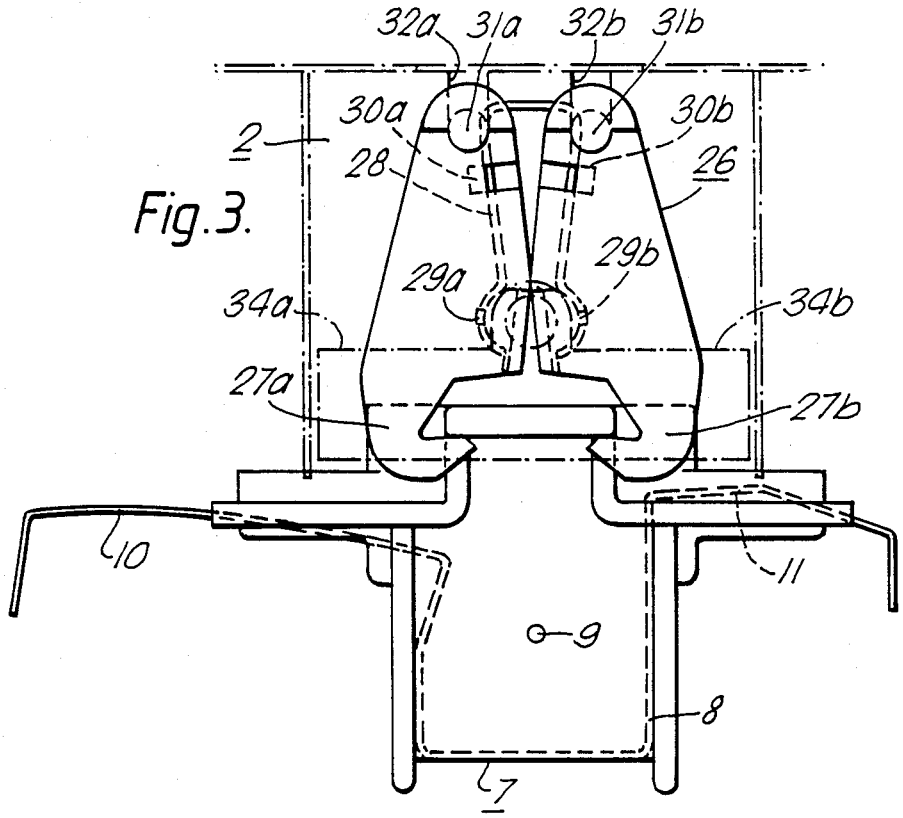
FIG. 3 is a cross section showing detail of a latch mechanism for retaining the corotron in the process unit taken on the line III—III in FIG. 2.

At its upper end the shield has extended portions 10 and 11 on its left-and right-hand sides respectively, as viewed in the drawing. These portions 10 and 11 define the path which a copy sheet follows as it passes through the cassette for the purposes of having a toner image transferred thereto, as described in more detail below. As shown in FIG. 2, the corotron 7 has end caps 21,22 fastened to opposite ends of shield 8. The end caps 21,22 are made of a plastics material. End cap 21 has a laterally-projecting pin extending from its side faces both into and out of the plane of FIG. 2. The pin 23 is accommodated in sockets 24 formed integrally in the cassette housing, two such sockets being provided, one on each side of the end cap 21. The pin and socket arrangement is such as to allow the corotron a small amount of vertical movement, typically 2 mm, at its pivoted end. At the opposite end of the corotron 7, the other end cap 22 has a longitudinally projecting tab 25 which engages in a latch mechanism 26 shown more clearly in FIG. 3. The tab 25 is held by two jaws 27*a*, 27*b* of the latch which are biased together by an inverted keyhole-shaped spring 28. The spring 28 is held in place by pairs of tabs 29*a*, 29*b*; 30*a*, 30*b* formed integrally on the inward face of the jaws 27*a*, 27*b*. The upper portion of each jaw 27*a*, 27*b* is provided with a protruding post 31*a*, 31*b* with an enlarged head 33*a*, 33*b* extending from the outward face. The post 31*a*, 31*b* are accommodated in slots 32*a*, 32*b* respectively in the cassette housing 2, thus providing a pivotal mounting for the jaws. The enlarged heads 33*a*, 33*b* which act to retain the latch in its own plane are present on the outside of the cassette housing as can be seen more clearly in FIGS. 2 and 6. The latch is also held in place by two bail bars 34*a*, 34*b* formed on a recessed portion of the internal wall of the cassette housing 2. The bail bars 34*a*, 34*b* are both joined to the cassette housing at each of their two ends, thereby providing a slot between the bars and the cassette housing through which the jaws 27*a*, 27*b* are threaded, thereby limiting their pivotal movement as well as holding them in their own plane (see FIG. 6). When the cassette is outside the main assembly of the copying machine, the jaws 27*a*, 27*b* of the latch 26 are closed to grip tab 25 and so support the corotron as shown in FIG. 3. However, the latch is adapted to be opened automatically to release the corotron when the cassette is inserted into the main assembly of a copying machine, which enables the corotron to be located accurately relative to the photoreceptor and also enables the corotron to be hinged open about pivot pin 23 to allow for clearance of jammed copy sheets, as described in more detail below.

As can be seen from FIGS. 1 and 2, the outside of the corotron shield 8 forms part of the external wall of the cassette housing 2.

Figure 4:
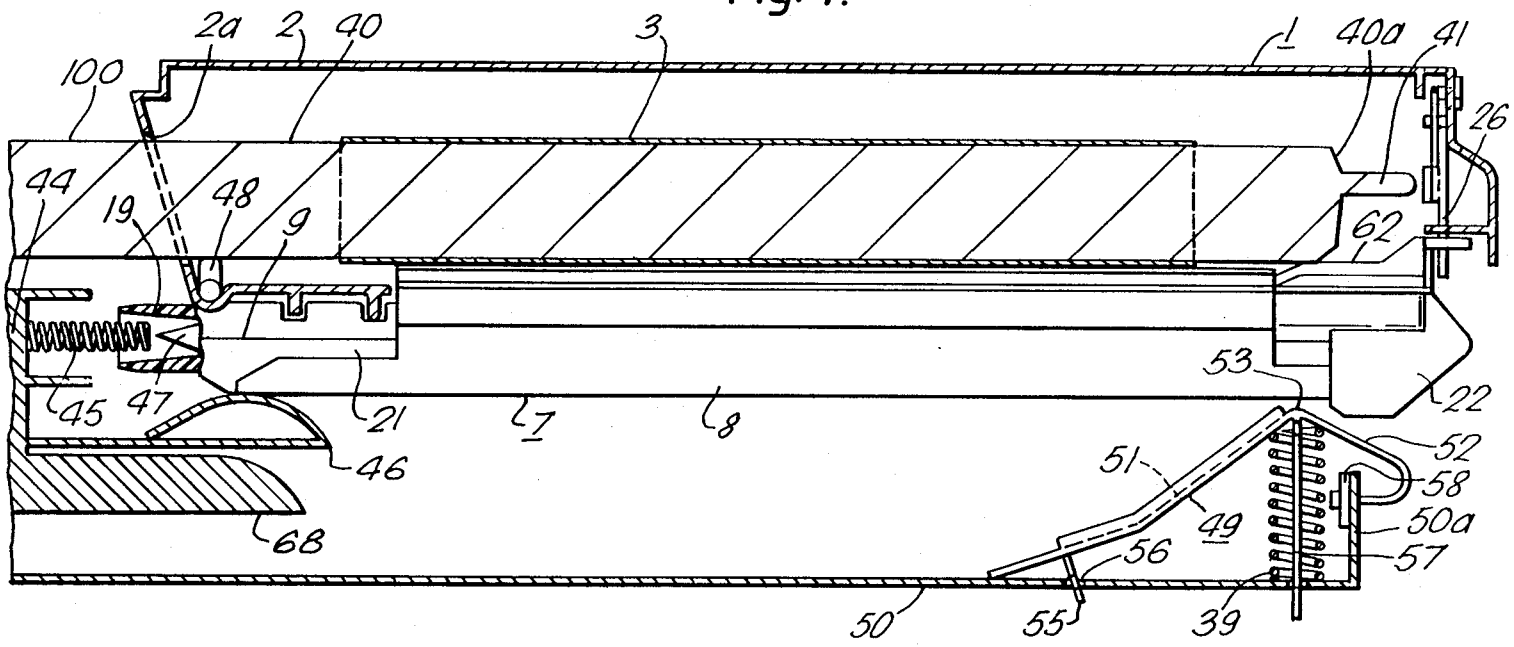
FIG. 4 is a sectional view of the process unit of FIG. 2 partially inserted in the main assembly of a xerographic copier.

FIG. 4 shows the situation as the cassette 1 is almost, but not quite, fully inserted into its operative position in the main assembly 100 of a reproducing machine. For the sake of clarity the whole of the machine main assembly is not shown in this Figure. As the cassette is first inserted into the main assembly, the support member 40, which is integral with the main assembly, enters the cassette 1 through aperture 2*a* in the housing 2 and threads through the belt photoreceptor 3. To facilitate this threading operation the support 40 is provided with a chamfered leading end face 40*a*. Extending from the end face 40*a* is a spigot 41, the purpose of which is to actuate the latch mechanism 26 when the cassette is fully inserted in the main assembly as explained in more detail below.

With the cassette in the position shown in FIG. 4, electrical connection is about to be made with the corotron 7 by means of compression spring 45 which is fastened to block 44 of the main machine assembly. The spring 45 is electrically connected to a high voltage source. As the cassette approaches the position shown in FIG. 4, the spring 45 enters the tape bore of socket member 46 projecting from the leading face of the corotron end cap 21. In FIG. 4, the socket member is cutaway for enhanced clarity of the features being discussed here. As the cassette continues to be inserted the spring 45 engages around electrical contact 47 protruding within the socket 46. Contact 47 is tapered in such a manner as to permit the spring 45 to thread over it easily and to ensure intimate electrical contact therewith. The contact 47 is electrically connected to corona wire 9.

With the cassette at the position shown in FIG. 4, the underside of leading end cap 21 has just engaged leaf spring 46 which extends cantilever-fashion from the block 44 of the main assembly 100. Spring 46 acts to urge the corotron 7 up towards the support 40 until a projection 48 provided on the upper surface of end cap 21 abuts the underside of support member 40. Projection 48 thus acts as a spacer.

At the same time the end cap 22 at the trailing end of the corotron approaches ramp flexure 49 fastened on a surface 50 which may be withdrawn from the main assembly of the reproducing machine as discussed in more detail below.

Figure 5:
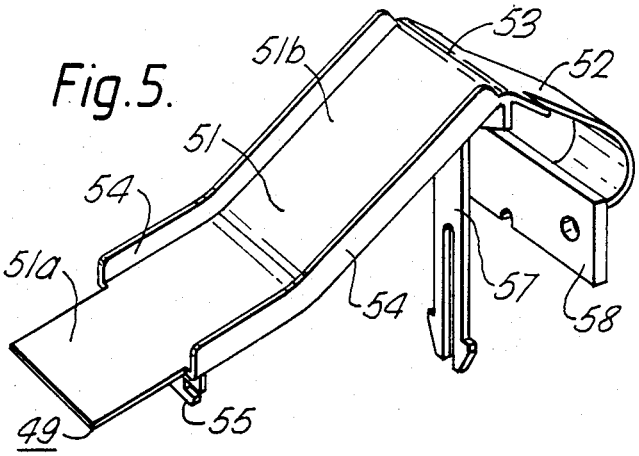
FIG. 5 is a perspective view of a ramp flexure member which supports the transfer corotron in the main assembly.

The ramp flexure 49 which is shown in more detail in FIG. 5 is made of plastics material, for example polypropylene and comprises a double ramp 51, 52 in back-to-back configuration defining an apex 53 therebetween. The inwardly extending ramp 51 comprises a lower sloping portion 51*a* and an integral upper portion 51*b* which is more steeply inclined. The ramp 51 is slightly wider than the corotron end cap 22 and is provided with upstanding wall portions 54 at its edges, thus presenting a guide channel for the corotron. Extending from the underside of lower ramp portion 51*a* is a T-shaped lug 55 which extends through a slot 56 in the surface 50 to lock the ramp member 59 thereto. The ramp member is further fastened to the surface 50 by a bifurcated barbed member 57 extending through a slot 58 in the surface 50. The outwardly extending ramp portion 52 is shorter than the inwardly extending portion 51 and at its lower end curves inwardly and terminates in a block 58 which is bolted to an upstanding flange 50*a* at the outside edge of surface 50. The ramp portion 52 provides a guide surface for the leading end cap 21 of corotron 7 when the cassette is first inserted into the main assembly 100.

Figure 6:
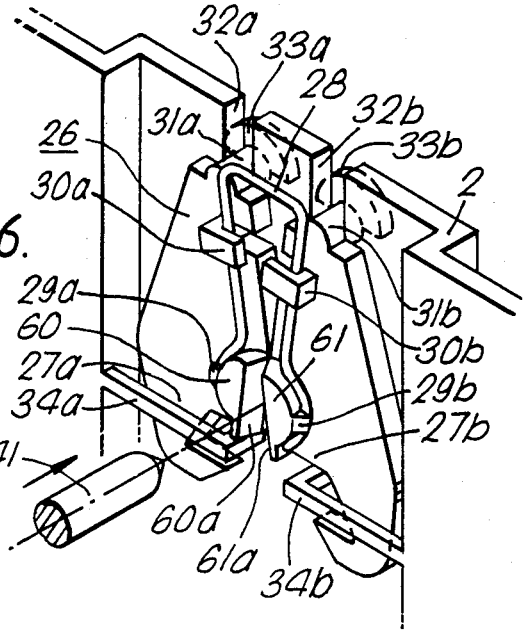
FIG. 6 is a perspective view of the latch in the closed position when the process unit is partially inserted into the main assembly.
Figure 7:
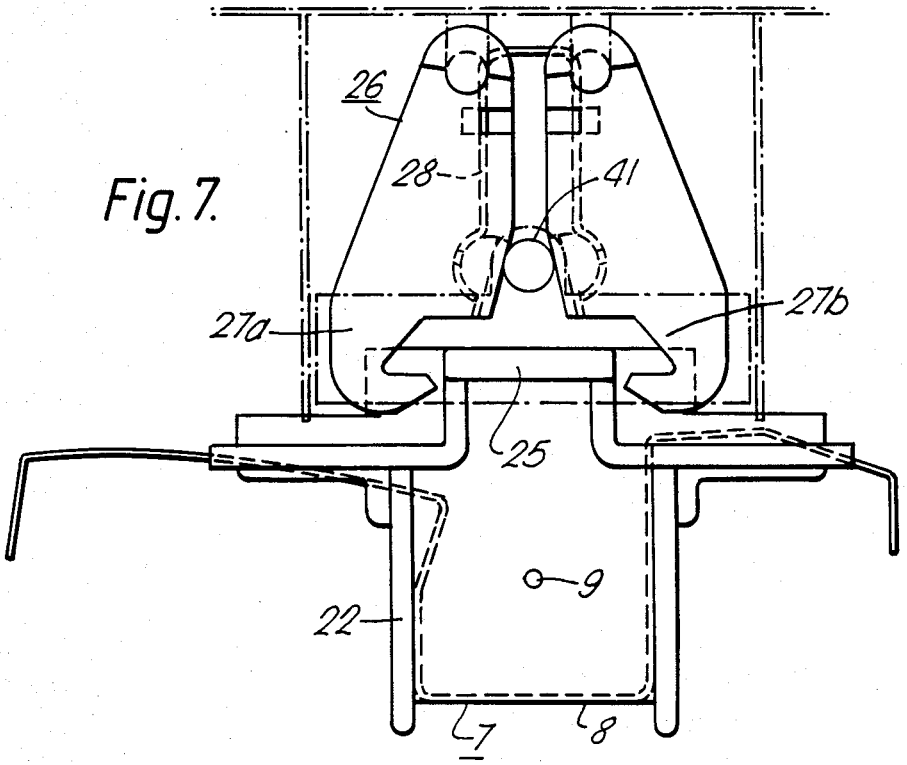
FIG. 7 is a cross section showing detail of the latch mechanism of FIG. 2, but with the latch in the open position.

As the cassette is inserted further, the spigot 41 of the support member 40 approaches the latch mechanism 26. Referring to FIG. 6, it can be seen that the spigot 41 is aligned with two substantially semicircular boss members 60,61 at the facing edges of the two jaws 27*a*, 27*b*. The boss members 60,61 are each chamfered at their inwardly directed faces 60*a*, 61*a* respectively. As the cassette approaches its fully inserted position within the main assembly 100 the spigot 41 engages the bosses 60,61 at their chamfered surfaces 60*a*, 61*a* and prizes them apart against the bias of spring 28, thus forcing the jaws 27*a*, 27*b* to move apart thereby releasing tab 25 of corotron end cap 22 as shown in FIG. 7. At this stage the trailing end of the corotron will drop slightly under its own weight until it abuts ramp portion 52 of ramp flexure 49.

Figure 8:
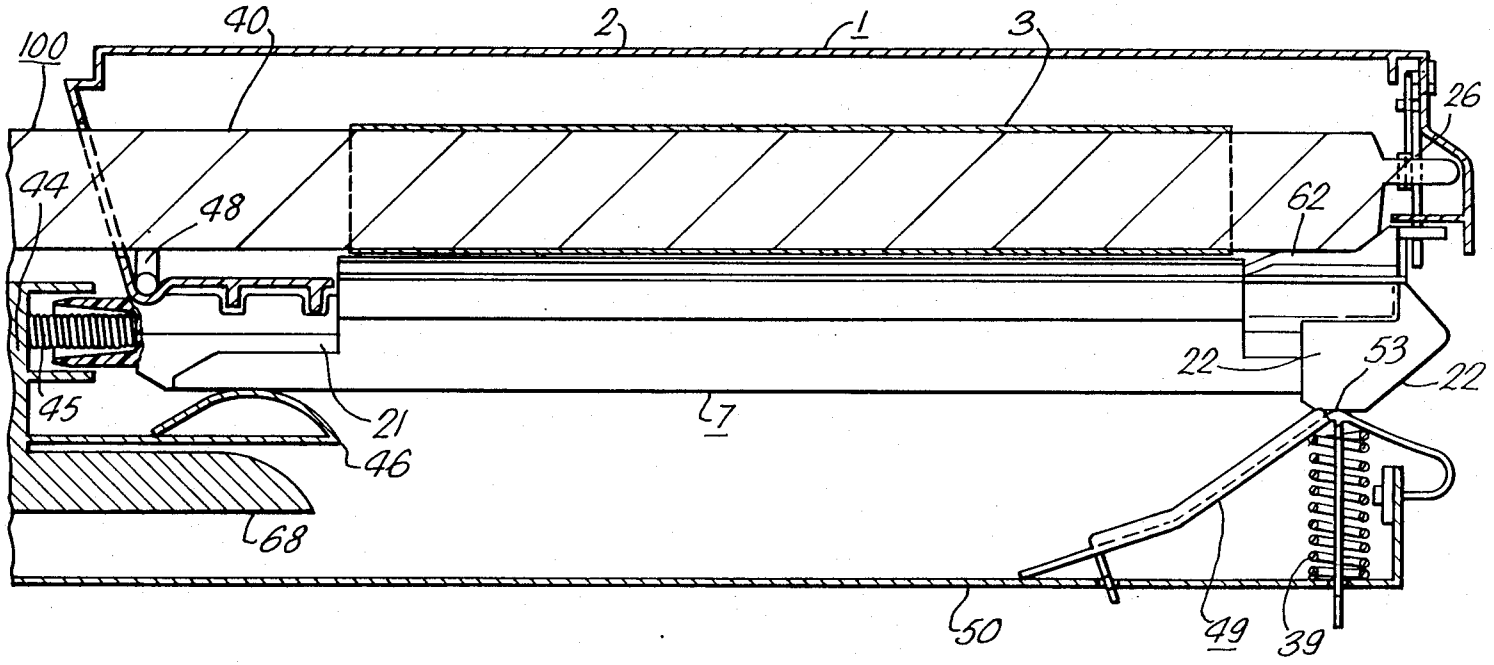
FIG. 8 is a sectional view of the process unit of FIG. 2 fully inserted in the main assembly.
Figure 9:
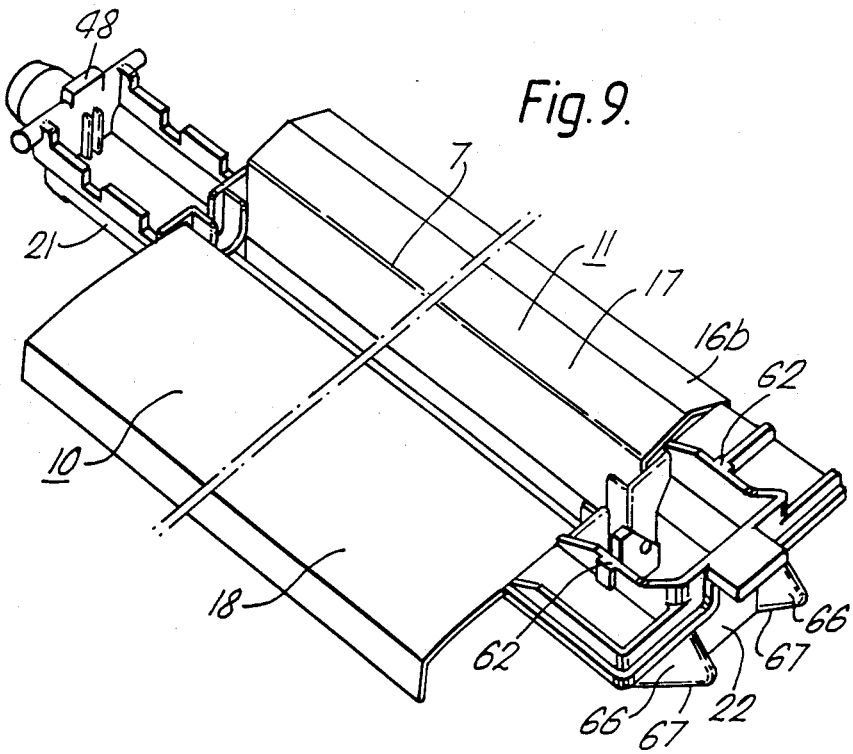
FIG. 9 is a perspective view of the transfer corotron.

The cassette is then pushed all the way to its fully inserted position in which the underside of end cap 22 is supported by the apex 53 of ramp flexure 49, as shown in FIG. 8. The ramp flexure 49 acts to urge the trailing end of the corotron up towards the support 40 until two flange-like projections 62 provided on the top side of end cap 22 abut the underside of support member 40 and thus act as spacers. Thus the projection 48 on end cap 21 and the two projections 62 on end cap 22 which can be seen most clearly in FIG. 9 act as spacers which accurately locate the corotron 7 relative to the support member 40.

As described in our aforementioned copending U. S. Application Ser. No. 038,093 the photoreceptor belt 3 may be tensioned after the cassette has been fully inserted in the main assembly, e.g. by using a pair of rollers (not shown here) which can be moved apart, whereupon the belt 3 will adopt an operative position in which it conforms closely with the support member 40. It follows, therefore, that by accurately locating the corotron 7 relative to the support member 40 it is also located accurately relative to the photoreceptor, as required.

Although the ramp flexure 49 may itself be sufficiently resilient to urge the corotron 7 against the support member 40 additional bias may be provided by threading a compression spring 39 over bifurcated member 57 so that it buts against the apex 53 of the flexure 49 at its upper end and against the surface 50 at its lower end.

As shown in FIG. 1, an aperture 14 is present between the right-hand extension 11 of corotron shield 8 and the main part of the cassette housing to enable a copy sheet to enter the process unit for the purpose of transferring an image thereto from the photoreceptor belt 3 in the vicinity of the transfer corotron when the cassette is inserted into the main assembly of the copying machine. The aperture 14 is in the form of a slot extending substantially the full width of the cassette and is relatively narrow, for example, 2 mm wide. Thus the slot is sufficiently wide to permit a copy sheet to enter the cassette, but narrow enough to provide appreciable protection for the photoreceptor from damage, contamination, and light exposure, thus prolonging the useful life of the photoreceptor.

The path which a copy sheet follows as it passes through the cassette for image transfer purposes is denoted by an arrow in FIG. 1. The external wall portion 15 of the main part of the cassette housing is shaped so as to deflect and guide the approaching copy sheets towards the aperture 14. Furthermore, the extreme right-hand side of the extended portion 11 of corotron shield 8 has a downturned lip 16 inclined obtusely relative to the adjacent plateau portion 17. The downturned lip 16 thus also acts to guide approaching copy sheets towards the aperture 14.

As the copy sheet enters the cassette it follows the path defined between the photoreceptor belt 3 and the plateau portion 17 of the corotron shield extension 11. The copy sheet then passes over the main part (i.e. the shield 8 and the wire 9) of the transfer corotron 7 where the toner image is transferred from the photoreceptor belt to the copy sheet itself in known manner. From there the copy sheet traverses the slightly upwardly inclined ramp 18 forming part of the shield extension 10 on the left-hand side of the corotron 7, and thence to aperture 20 in the cassette housing where the copy sheet exits the cassette for further processing, in particular for the toner image to be fixed permanently to the copy sheet using techniques well known to persons skilled in the art.

Figure 10:
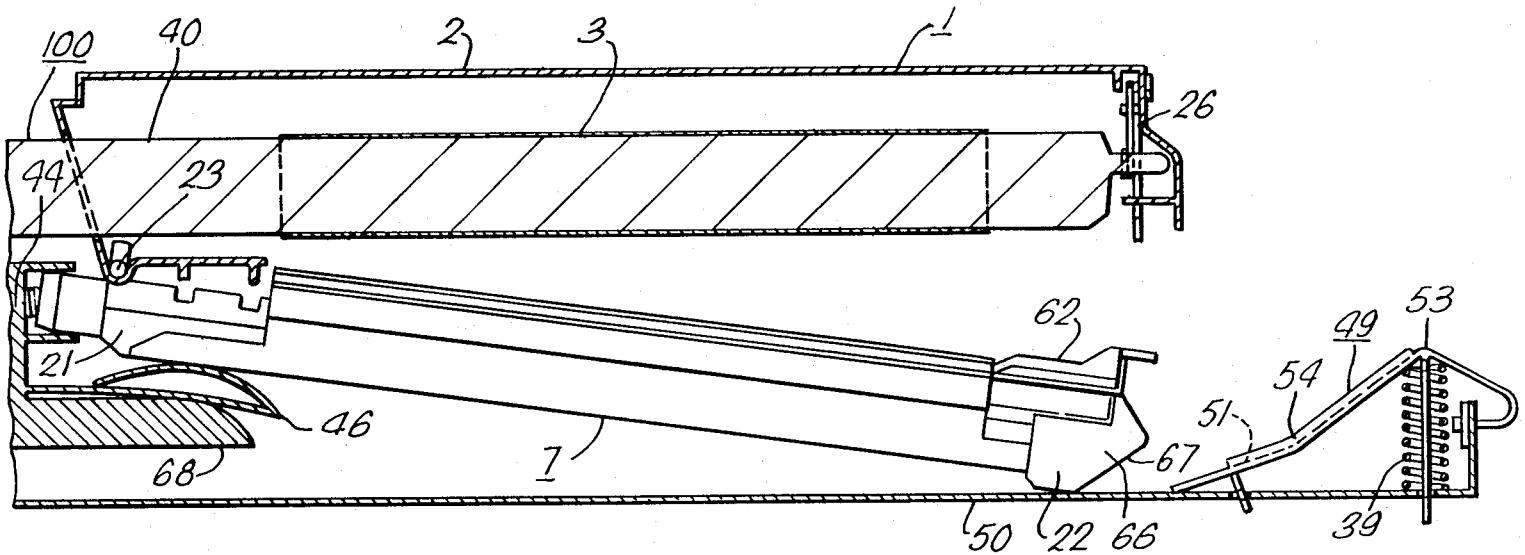
FIG. 10 is a sectional view of the process unit of FIG. 8 when it is fully inserted in the main assembly with the transfer corotron in its hinged-open position.

In case a copy sheet becomes jammed while it passes through the cassette 2, surface 50 with the ramp flexure 49 mounted thereon may be withdrawn manually from the main assembly 100 of the reproducing machine when the cassette is fully inserted therein, as shown in FIG. 10. As the surface 50 and ramp 49 are withdrawn the end cap 22 of corotron 7 will begin to descend the ramp 51 of ramp flexure 49, because it is no longer retained by latch 26. The end cap 22 is guided down the ramp 51 by edge wall portions 54.As the free end of the corotron descends, it pivots about hinge pin 23 at the other end cap 21. Leaf spring 46 is displaced against subjacent platform 68 extending from the block 44 in the main assembly 100. As the surface 50 continues to be withdrawn, the corotron end cap 22 continues to descend ramp portion 51 until it engages the surface 50 which limits the corotron's pivotal movement. FIG. 10 shows the corotron 7 hinged in its fully open position away from the photoreceptor to permit access to the transfer region of the cassette, especially for clearing copy sheets which may have jammed there without damaging the photoreceptor. Once the jam has been cleared, the corotron 7 is returned to its former operative position simply by reinserting surface 50. Initially the end cap 22 will slide along the surface 50 until the ramp flexure 49 approaches when it will begin to ascend ramp portion 51 again guided by edge wall portions 54. For this purpose, end cap 22 is flanked by a pair of wings 66 with outwardly extending sloping faces 67 complementary to ramp 51 to facilitate sliding thereover. When the surface 50 is returned to its fully inserted position, the corotron end cap 22 reverts to its former position at the apex 53 of ramp flexure 49 with the projecting flanges 62 abutting the supporting member 40 of the main assembly 100, as shown in FIG. 8. When it comes to removing the cassette 1 from the main assembly 2 the spigot 41 of support 40 disengages from the latch 26 whereby the jaws **27*a*, 27*b* of the latch close together under the bias of spring 28 to regrip the tab 25 of corotron end cap 22. Thus, when the cassette is removed from the main assembly the transfer corotron is automatically latched back into, and as such again becomes an integral part of, the cassette housing 2**.

Referring now to FIG. 11, there is shown schematically a xerographic printing machine 110 having the removable process unit 1 of the present invention in its operational position in the main assembly 100. The machine includes an endless flexible photoreceptor belt 3 mounted for rotation in the clockwise direction as shown about support rollers **111*a* and 111*b* to carry the photosensitive imaging surface 112 of the belt 3 sequentially through a series of xerographic processing stations, namely a charging station 114, an imaging station 116, a development station 118, a transfer station 120, and a cleaning station 122**.

The charging station 114 comprises a corotron 6 which deposits a uniform electrostatic charge on the photoreceptor belt 3. The photoreceptor belt 3, the charge corotron 6, the developer device 4, the transfer corotron 7, and the blade cleaner 5 may all be incorporated in a process cassette 1 adapted to be removably mounted in the main assembly 100 of the xerographic copier as described in aforementioned copending application Ser. No. 038,093.

An original document D to be reproduced is positioned on a platen 124 and is illuminated in known manner a narrow strip at a time by a light source comprising a tungsten halogen lamp 126. Light from the lamp is concentrated by an elliptical reflector 125 to cast a narrow strip of light on to the side of the original document D facing the platen 124. Document D thus exposed is imaged on to the photoreceptor 1 via a system of mirrors M1 to M6 and a focusing lens 127. The optical image selectively discharges the photoreceptor in image configuration, whereby an electrostatic latent image of the original document is laid down on the belt surface at imaging station 116. In order to copy the whole original document the lamp 126, the reflector 125, and mirror M1 are mounted on a full rate carriage (not shown) which travels laterally at a given speed directly below the platen and thereby scans the whole document. Because of the folded optical path the mirrors M2 and M3 are mounted on another carriage (not shown) which travels laterally at half the speed of the full rate carriage in order to maintain the optical path constant. The photoreceptor 1 is also in motion whereby the image is laid down strip by strip to reproduce the whole of the original document as an image on the photoreceptor.

By varying the speed of the scan carriages relative to the photoreceptor belt 1 it is possible to alter the size of the image along the length of the belt, i.e. in the scanning direction. In full size copying, that is to say with unity magnification, the speed of the full rate carriage and the speed of the photoreceptor belt are equal. Increasing the speed of the scan carriage makes the image shorter, i.e. reduction, and decreasing the speed of the scan carriage makes the image longer, i.e. magnification.

The image size can also be varied in the direction orthogonal to the scan direction by moving the lens 127 along its optical axis closer to the originl document i.e. closer to mirrors M2 and M3, for magnification greater than unity, and away from the mirrors M2 and M3 for reduction, i.e. magnification less than unity. When the lens 127 is moved, the length of the optical path between the lens and the photoreceptor, i.e. the image distance, is also varied by moving mirrors M4 and M5 in unison to ensure that the image is properly focused on the photoreceptor 1. For this purpose mirrors M4 and M5 are suitably mounted on a further carriage (not shown).

At the development station 118, a magnetic brush developer device with a developer roll 128 develops the electrostatic latent image into visible form. Here, toner is dispensed from a hopper (not shown) into developer housing 129 which contains a two-component developer mixture comprising a magnetically attractable carrier and the toner, which is deposited on the charged area of belt 1 by a developer roll 128.

The developed image is transferred at transfer station 120 from the belt to a sheet of copy paper according to the practice of the present invention. The copy paper is delivered into contact with the belt in synchronous relation to the image from a paper supply system 131 in which a stack of paper copy sheets 132 is stored on a tray 133. The top sheet of the stack in the tray is brought, as required, into feeding engagement with a top sheet separator/feeder 134. Sheet feeder 134 feeds the top copy sheet of the stack towards the photoreceptor around a 180° path via two sets of nip roll pairs 135 and 136. The path followed by the copy sheets through the aperture in the cassette is denoted by a broken line. At the transfer station 120 transfer corotron 7 provides the electric field to assist in the transfer of the toner particles thereto.

The copy sheet bearing the developed image is then stripped from the belt 1 and subsequently conveyed to a fusing station 138 which comprises a heated roll fuser 139 to which release oil may be applied in known manner. The image is fixed to the copy sheet by the heat and pressure in the nip between the two rolls 139 and 140 of the fuser. The final copy is fed by the fuser rolls into catch tray 141 via two further nip roll pairs 142 and 143.

After transfer of the developed image from the belt some toner particles usually remain on the surface of the belt, and these are removed at the cleaning station 122 by a cleaner blade 5 which scrapes residual toner from the belt. The toner particles thus removed fall into a receptacle 145 below. Also, any electrostatic charges remaining on the belt are discharged by exposure to an erase lamp 146 which provides an even distribution of light across the photoreceptor surface. The photoreceptor is then ready to be charged again by the charging corotron 6 as the first step in the next copy cycle.

The patents and applications referred to herein are hereby specifically and totally incorporated herein by reference.

From the foregoing it will be evident that various modifications may be made within the scope of the present invention. For example, instead of a flexible belt the imaging member may comprise a photoreceptor drum as commonly used in xerographic machines. Moreover, apart from the transfer corotron, the cassette may enclose additional or alternative processing means to those described above. In addition, while the invention has been illustrated with respect to copying apparatus it will be understood that it may be used in printer apparatus wherein a light beam such as a laser beam may be used to selectively discharge portions of the photoconductor. All such modifications and embodiments as may readily occur to the artisan are intended to be within the scope of the appended claim.

We claim:

1. A process unit adapted to be removably mounted in a main assembly of a reproducing machine comprising a housing enclosing an imaging member and an elongate charging device hingedly mounted at a first end, the second opposite end thereof being retained by latch means comprising a pair of jaw members which are mutually biased together to grip the second end of the charging device when the process unit is withdrawn from the main assembly.

2. A process unit as claimed in claim 1, wherein the second end of the charging device is provided with a projecting tab adapted to be gripped by the jaw members when the process unit is withdrawn from the main assembly.

3. A process unit as claimed in claim 1 wherein the latch means is adapted to release the charging device when the process unit is inserted into the main assembly.

4. A process unit as claimed in claim 1, wherein the charging device is a transfer corotron for transferring an image from the imaging member to a copy sheet.

5. A reproducing machine comprising a main assembly and a process unit adapted to be removably mounted in said main assembly, said process unit comprising a housing enclosing an imaging member and an elongate charging device hingedly mounted at a first end, the second opposite end thereof being retained by latch means comprising a pair of jaw members which are mutually biased together to grip the second end of the charging device when the process unit is withdrawn from the main assembly.

6. A reproducing machine as claimed in claim 5, wherein the main assembly comprises means for supporting the charging device in a predetermined location relative to the main assembly when the process unit is inserted therein.

7. A reproducing machine as claimed in claim 6, wherein the support means comprise resilient flexures.

8. A reproducing machine as claimed in claim 6, wherein respective support means are provided at each of the two ends of the charging device, the support means at the second end of the charging device being withdrawable from the main assembly whereby the charging device is pivotable about the hinged end.

9. A reproducing machine as claimed in claim 8, comprising a member providing an abutment which limits the pivotal movement of the charging device.

10. A reproducing machine as claimed in claim 8, wherein the withdrawable support means at the second end of the charging device comprises a double sided ramp member in back-to-back configuration defining an apex therebetween, wherein the second end of the charging device is supported by the apex when both the ramp member and the process unit are fully inserted in the main assembly.

11. A reproducing machine as claimed in claim 10, wherein the latch means is adapted to release the charging device when the process unit is inserted into the main assembly.

12. A reproducing machine as claimed in claim 10, wherein the charging device is a transfer corotron for transferring an image from the imaging member to a copy sheet.

13. A reproducing machine as claimed in claim 8, wherein the second end of the charging device is provided with a projecting tab adapted to be gripped by the jaw members when the process unit is withdrawn from the main assembly.

* * * * *